US007293332B2

(12) United States Patent
Maillard

(10) Patent No.: US 7,293,332 B2
(45) Date of Patent: Nov. 13, 2007

(54) DEVICE FOR FASTENING AN EXTREMITY OF A LINK TO AN OBJECT

(76) Inventor: Frederic Maillard, 20, route de Bourguillon, CH-1723 Marly (CH)

( * ) Notice: Subject to any disclaimer, the term of this patent is extended or adjusted under 35 U.S.C. 154(b) by 0 days.

(21) Appl. No.: 10/567,736

(22) PCT Filed: Aug. 16, 2004

(86) PCT No.: PCT/CH2004/000513

§ 371 (c)(1),
(2), (4) Date: Feb. 10, 2006

(87) PCT Pub. No.: WO2005/018368

PCT Pub. Date: Mar. 3, 2005

(65) Prior Publication Data

US 2006/0207067 A1 Sep. 21, 2006

(30) Foreign Application Priority Data

Aug. 22, 2003 (CH) ..... 1435/03

(51) Int. Cl.
*A44C 5/14* (2006.01)

(52) U.S. Cl. ..... 24/265 B; 24/265 WS

(58) Field of Classification Search ..... 24/265 B, 24/265 WS; 224/164, 177; 368/281, 282
See application file for complete search history.

(56) References Cited

U.S. PATENT DOCUMENTS 1,991,287 A 2/1935 Valentine
4,217,681 A * 8/1980 Grohoski et al. ..... 24/265 WS
6,014,793 A 1/2000 Howald
6,023,816 A 2/2000 Okada et al.

FOREIGN PATENT DOCUMENTS

EP 0 876 114 A 11/1998
EP 0 908 112 A 4/1999
JP 2000298179 A * 10/2000

OTHER PUBLICATIONS

International Search Report of International Application PCT/CH2004/000513 mailed Nov. 3, 2004.

* cited by examiner

*Primary Examiner*—James R Brittain
(74) *Attorney, Agent, or Firm*—Westerman, Hattori, Daniels & Adrian, LLP.

(57) ABSTRACT

The fastening device comprises a housing having a joint for connecting to the link, and two coaxial pins for joining it to the object, of which at least one is mounted in a manner that enables it to slide between two positions, one being retracted from the wall of the housing and the other projecting from the wall of the housing for engaging inside an opening of the object, coaxial to a second opening for accommodating the other of these pins. The fastening device also comprises an elastic device for attempting to constantly hold the sliding pin in the retracted position and an activating element associated with a cam for displacing the sliding pin into the other position. When the sliding pin is in the retracted position, the internal extremities of the pins abut against one another, their respective surfaces being adapted for providing a space at the periphery thereof capable of receiving the extremity of a position of the cam.

19 Claims, 1 Drawing Sheet

Fig. 2

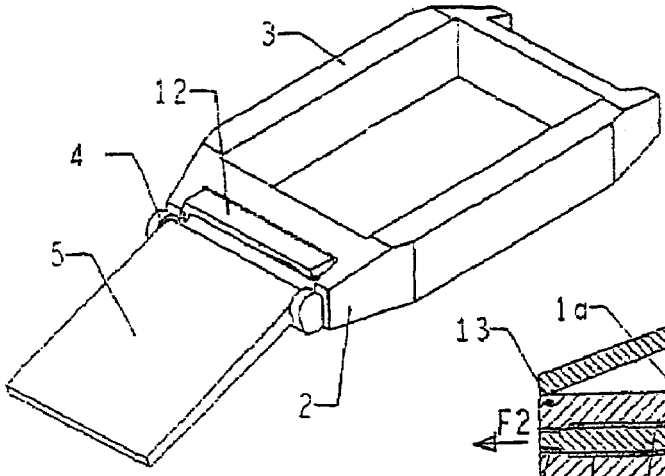
Fig.1
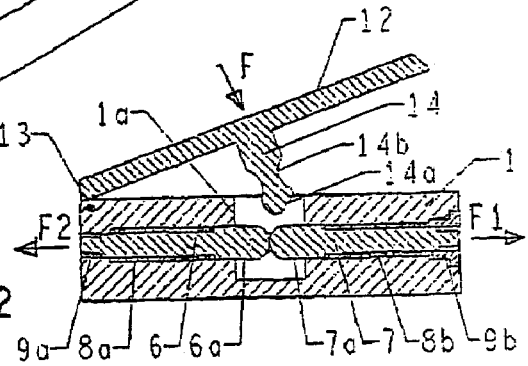
Fig.2
Fig.4
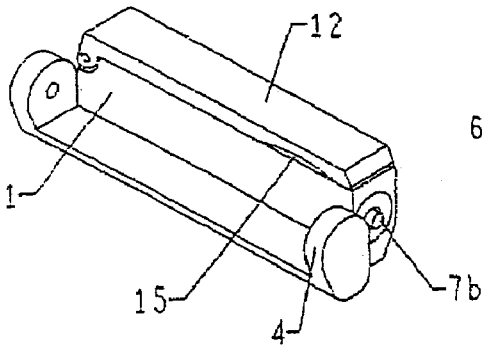
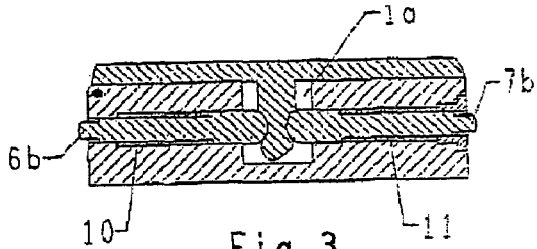
Fig.3
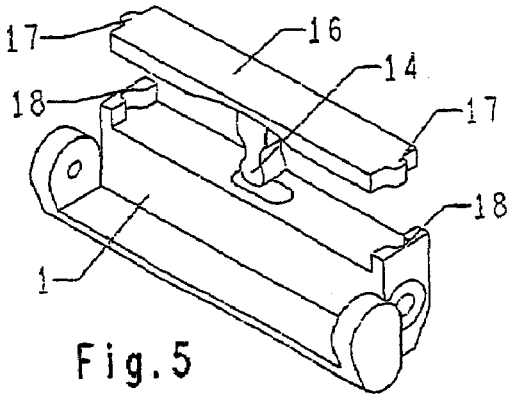
Fig.5

DEVICE FOR FASTENING AN EXTREMITY OF A LINK TO AN OBJECT

The present invention relates to a device for fastening an end of a strap, particularly a bracelet, to an object, particularly a watch case, comprising a casing having means of connection to said strap and two coaxial pins for connecting it to said object, at least one of which is mounted slidingly between two positions, one retracted, the other protruding from the wall of the casing to engage in an opening of said object, coaxial with a second opening to receive the other of said pins, elastic return means to tend to keep said sliding pin constantly in the retracted position and an actuation member, associated with a cam, to move said sliding pin into said other position.

The problem of fastening a strap, in particular a watch bracelet to a watch case has already been the subject of a very large number of solutions. The most common method of fastening with a pushpin is relatively difficult to put in place and requires, in addition to appropriate tools, a dexterity that most people wearing a bracelet watch do not have.

That is why for a long time solutions have been proposed that make it possible to change the bracelet without tools and that require such a low degree of dexterity that they make it possible for practically everyone to change a bracelet.

The need to change watch bracelets is demonstrated on several occasions in everyday life. This need may result from a simple desire to match the bracelet to an activity or to a clothing style. In this way a diver dressed in a diving suit cannot wear his watch on his suit without changing either the length of the bracelet, or the bracelet. It is evident that only a fastening device making it possible to, change the bracelet easily and without tools makes it possible to respond to this ever more frequent demand.

Nevertheless, such a device must not only respond to criteria putting the operation of bracelet-changing within the grasp of any user. Specifically, if it can be removed easily and without tools, there is usually then a great risk that the bracelet can be removed accidentally, without the wearer of the watch noticing, which is as unacceptable as the watch is a costly object. It is therefore just as essential that such a device has, despite the fact that it is intended to make the removal of the bracelet easier, a degree of safety that is as high as the pushpin fastening systems, which is most frequently incompatible.

In EP 876 114, a fastening device has been proposed in which a cam is engaged with the inner ends of two sliding pins pressed by springs against the cam. According to one embodiment, the cam is mounted slidingly in a direction transverse to the sliding axis of the pins and is itself pressed outward by a spring. In this position, the cam pushes the pins outward in the position of assembly with the fastening openings of the watch case horns. To release these pins from these openings, it is sufficient to exert a pressure on the sliding member supporting the cam. Now, such a pressure may be accidental, thus creating a risk of unintentional separation of the bracelet and the watch.

This same document proposes means for preventing this risk. One of these means consists in making it possible to have the cam control member, which has a circular pushbutton shape, in two angular positions about its axis of revolution, one of which corresponds to an axial locking position. Because of, the very small diameter that this cam control pushbutton may have, its rotation without the aid of a tool is at least problematical. This document has also proposed a rotary cam controlled by a rotary control member, but this solution explicitly requires the use of a screwdriver to rotate the cam.

It may therefore be noted that, in the prior art, there is no solution capable of satisfying all the required conditions, that is a fully manual control, with no tools and total security with respect to the risks of accidental separation between the bracelet and the watch case, or any other strap with any other object.

The object of the present invention is to remedy, at least partially, the aforementioned disadvantages.

For this purpose, the subject of the present invention is a device for fastening an end of a strap, particularly a bracelet, to an object, particularly a watch case according to claim.

Separating the bracelet and the case is the result of separating the actuation arm associated with the cam from the casing, so that it is necessary to take hold of the free end of the actuation arm and separate it from the case, which cannot be done accidentally, particularly if, advantageously, the actuation arm is placed on the side of the casing intended to come against the arm of the wearer of the bracelet watch. Consequently, in this case, the bracelet watch must first be removed to move the control arm to the position separated from the casing of the device.

Preferably, the control arm is held in the position pressed down against the casing by coupling means. Advantageously, these coupling means are arranged by a second, concave-shaped form of the cam, situated between the first portion of the cam and the actuation arm, to receive the inner ends of the pins pressed into the concave-shaped portion of the cam, so that it is necessary not only to act on the arm in its pushed in position, for example by means of a nail inserted between the arm and the casing of the device, but it is also necessary to overcome the coupling force of the control arm. For this purpose, a thumbnail groove is preferably made in one of the adjacent faces of the arm or of the casing to make it possible to insert a nail therein to raise the control arm.

The appended drawing illustrates, schematically and as an example, an embodiment and a variant of the device, that is the subject, of the present invention, for fastening an end of a strap, particularly a bracelet, to an object, particularly a watch case.

FIG. 1 is a view in perspective of this device of a watch case and a portion of bracelet;

FIG. 2 is a view in section of this device along the axis of the fastening pins, with the pins in the retracted position;

FIG. 3 is the same view in section similar to FIG. 2 in the position of the pins protruding from the walls of the casing of the device;

FIG. 4 is a view in perspective of the device alone;

FIG. 5 is a view in perspective of a variant of the preceding embodiment.

The device illustrated by FIGS. 1 to 4 comprises a fastening casing 1 with a generally parallelepipedic shape, whose length corresponds substantially to that of the space separating the horns 2 of the watch case 3. In the embodiment illustrated, the fastening casing 1 is fixedly attached to a pushpin fastening member 4 of a length of bracelet 5. In the case of a metal articulated chain bracelet, it is evident that the fastening member 4 may be shaped to have a complementary shape capable of receiving an adjacent link of the bracelet. Consequently, the fastening member 4 which, in this example, is shaped to receive a bracelet of the leather bracelet type, may have any shape appropriate to the bracelet that is intended to be connected to a watch case. It is in this way that, in the case of a link bracelet, it may have an outer shape corresponding at least partially to that of the links of the bracelet in order to fit in with the bracelet.

The mechanism of the fastening device itself is more particularly illustrated by FIGS. 2 and 3 in which it is represented in the two positions, inactive respectively active. This mechanism comprises two coaxial pins 6, 7 each mounted slidingly in two coaxial bores 8*a*, 9*a*, 8*b*, 9*b*. The bores 8*a*, 8*b* have larger diameters than the bores 9*a*, 9*b* and are used for sliding the larger diameter rear parts 6*a*, respectively 7*a*, of the pins 6 and 7. The annular spaces made between the bearing surfaces connecting the rear parts 6*a*, 7*a* of the pins 6, 7 on the one hand, and the bearing surfaces connecting the bores 8*a*, 9*a*, respectively 8*b*, 9*b* on the other hand, are used to receive two return coil springs 10, respectively 11, that are compressed between the two bearing surfaces and consequently exert on each pin 6, 7 an axial force which tends to press the inner ends of these two pins 6, 7 against one another, as illustrated by FIG. 2.

An arm 12 is articulated at one of its ends about a shaft 13 of the fastening casing 1. A cam 14 extends laterally to this arm 12 in the direction of the casing 1 which has an opening 1*a* to allow this cam 14 to pass. The latter may then rest between the two inner ends of the pins 6, 7 that have a rounded shape, thus making a space increasing from their centers, where they are abutting, to their peripheries. This shape allows the end 14*a* of the cam 14 to come into contact with the respective peripheries of the rounded surfaces. Thanks to this arrangement, when a force F is exerted on the arm 12, a part of this force exerted on the arm is transmitted to the two pins 6, 7 in the form of two opposing forces $F_1$, $F_2$ which tend to move the pins 6, 7 in opposite directions, against the respective forces exerted by the return springs 10, 11 on these pins 6, 7, making it possible to move them into the position illustrated by FIG. 3 in which the outer ends 6*b*, 7*b* of these pins protrude from the fastening casing 1 and can thus penetrate into the corresponding openings in the horns 2 of the watch case 3, ensuring the fastening of the bracelet 5.

Between the end part 14*a* of the cam 14 and the arm 12, the cam 14 has one part 14*b*, if the section of the cam 14 is circular, or two symmetrical, parts 14*b* if the section of the cam 14 is rectangular, of concave shapes intended to receive the inner rounded ends of the pins 6, 7. Thanks to this second portion of cam 14*b*, the opposing forces exerted by the return springs 10, 11 on the cam 14 by means of the pins 6, 7 opposes the separation of the arm 12 from the casing 1 and retains this arm thanks to the return forces of the springs, in the fastened position illustrated by FIG. 3.

Naturally, if this method of retaining the arm 12 on the casing 1 is preferred, nothing would prevent using other coupling means, for example between the free end of the arm 12 and the edge of the casing 1.

However, it should be noted that this preferred method of coupling the arm 12 in the engaged position of the pins 6, 7 has an additional advantage. After a long period of inaction, the pins 6, 7 of the fastening device risk being immobilized by clogging. If the user simply withdraws a cam that keeps them apart without first imparting a positive movement on the pins, the latter will remain immobilized. In addition to the fact that the concave portion 14*b* of the cam 14 makes it possible to keep the arm 12 in place, it also makes it possible to impart a positive movement on the pins 6, 7 to release them when the arm 12 is separated from the casing 1, which subsequently allows the return springs 10, 11 to act on these pins 6, 7 which otherwise might not retract.

To make it possible to exert manually on the arm 12 a force capable of overcoming that which opposes its opening, a thumbnail groove 15 (FIG. 4) is preferably made on one of the adjacent faces of the actuation arm 12 or of the fastening casing 1.

In addition to the advantages already mentioned, it will have been possible to note on reading the foregoing embodiment that the fastening device requires no modification of the watch case or of the bracelet. The pins 6, 7 simply replace the usual pushpins; as for the bracelet, it is preferably delivered furnished with the fastening device according to the invention, therefore ready to be attached to the watch case.

The actuation arm 12 articulated at one end to the casing 1 could, as a variant for example, be replaced by an actuation member 16 mounted on the casing 1 by means of guidance elements 17 intended to engage with complementary guidance elements 18, fixedly attached to the fastening casing 1, as illustrated by FIG. 5.

A variant (not shown) could also be envisaged, in which only one of the pins 6, 7 would be mounted slidingly in the casing 1, the other being fixed in the position protruding from the casing. In this case, this fixed pin would first be engaged in an opening of a horn of the watch case 3 and only the other would be moved by the cam 14 that is moved by the actuation member 12.

The invention claimed is:

1. A device for fastening an end of a strap to an object, comprising a casing having means of connection to said strap and two coaxial pins for connecting said strap to said object, at least one of which is mounted slidingly between two positions, one retracted, the other protruding from a wall of the casing to engage in an opening of said object, coaxial with a second opening to receive the other of said pins, elastic return means to tend to keep said sliding pin constantly in the retracted position and an actuation member, associated with a cam, to move said sliding pin into said other position, wherein, in the retracted position of said sliding pin, inner ends of said pins are abutting, respective surfaces of said pins being shaped to make a space on their periphery capable of receiving an end of a first portion of said cam, said actuation member being a manual member connected to said casing by guidance means defining a trajectory of movement of said actuation member, substantially perpendicular to an axis of said pins, this actuation member being capable of being moved between two stable limit positions along this trajectory, a first position of release and a second position of engagement of said sliding pin, said first portion of said cam being shaped to transform the force exerted to bring said actuation member into said second position into a force exerted on said sliding pin to move said sliding pin into said protruding position.

2. The device as claimed in claim 1 in which said actuation member has the shape of an arm articulated on said casing by one of its ends, said cam extending laterally to this arm, the latter being separated from said casing in said first position and being pressed down against said casing in said second position.

3. The device as claimed in claim 1, in which said actuation member has means for retaining said actuation member in said second engagement position of said sliding pin.

4. The device as claimed in claim 3, in which said cam comprises a second concave-shaped portion situated between said first portion and said arm, to receive the inner end of said sliding pin pressed into said concave-shaped portion by said elastic return means and serving as means for retaining said arm in a pressed down position.

5. The device as claimed in claim 1, in which said actuation member is situated on a side of its casing intended to be turned towards the arm supporting the object.

6. The device as claimed in claim 1, in which one of adjacent faces of the casing and of said actuation member has a thumbnail groove.

7. The device as claimed in claim 2, in which said actuation member has means for retaining said actuation member in said second engagement position of said sliding pin.

8. The device as claimed in claim 7, in which said cam comprises a second concave-shaped portion situated between said first portion and said arm, to receive the inner end of said sliding pin pressed into said concave-shaped portion by said elastic return means and serving as means for retaining said arm in the pressed down position.

9. The device as claimed in claim 2, in which said actuation member is situated on a side of its casing intended to be turned towards the arm supporting the object.

10. The device as claimed in claim 3, in which said actuation member is situated on a side of its casing intended to be turned towards the arm supporting the object.

11. The device as claimed in claim 4, in which said actuation member is situated on a side of its casing intended to be turned towards the arm supporting the object.

12. The device as claimed in claim 2, in which one of adjacent faces of the casing and of said actuation member has a thumbnail groove.

13. The device as claimed in claim 3, in which one of adjacent faces of the casing and of said actuation member has a thumbnail groove.

14. The device as claimed in claim 4, in which one of adjacent faces of the casing and of said actuation member has a thumbnail groove.

15. The device as claimed in claim 5, in which one of adjacent faces of the casing and of said actuation member has a thumbnail groove.

16. The device as claimed in claim 1, wherein the object is a watch case.

17. The device as claimed in claim 1, wherein the strap is a bracelet.

18. The device as claimed in claim 17, wherein the object is a watch case.

19. The device as claimed in claim 18, in which one of adjacent faces of the casing and of said actuation member has a thumbnail groove.

* * * * *